US005967326A

United States Patent [19]

Tessler et al.

[11] Patent Number: 5,967,326

[45] Date of Patent: Oct. 19, 1999

[54] TRAY FOR DISPLAYING A PLURALITY OF JEWELRY ITEMS AND INFORMATION RELATING TO THE JEWELRY ITEMS

[75] Inventors: Mark Tessler, Maplewood, N.J.; Edward Daniel Dudziak, Canyon Lake, Calif.

[73] Assignee: Tessler & Weiss/Premesco, Inc., Union, N.J.

[21] Appl. No.: 09/120,597

[22] Filed: Jul. 22, 1998

[51] Int. Cl.[6] ..... B65D 6/04; B65D 85/00

[52] U.S. Cl. ..... 206/566; 206/232; 206/459.5; 211/85.2

[58] Field of Search ..... 206/566, 6.1, 223, 206/232, 459.5; 211/85.2; 63/30

[56] References Cited

U.S. PATENT DOCUMENTS

| | | | |
|---|---|---|---|
| 1,096,616 | 5/1914 | Feverstein | 206/566 X |
| 1,501,770 | 7/1924 | Hanisch | 206/566 X |
| 1,709,937 | 4/1929 | Everard | 206/459.5 X |
| 2,001,681 | 5/1935 | Weller | 206/6.1 X |
| 2,080,630 | 5/1937 | Nathanson | 206/459.5 X |
| 2,144,968 | 1/1939 | Gerth | 206/566 X |
| 2,480,756 | 8/1949 | Michelson | 206/459.5 X |
| 2,883,048 | 4/1959 | Lentz | 206/566 X |
| 3,818,621 | 6/1974 | Hogue et al. | 63/30 X |
| 4,350,249 | 9/1982 | Caston | 206/566 |
| 4,448,304 | 5/1984 | Weinzettel et al. | 206/223 |
| 4,685,568 | 8/1987 | Elsfelder | 206/566 X |
| 4,773,530 | 9/1988 | Holtzman et al. | 206/232 |
| 4,779,588 | 10/1988 | Trisl | 206/566 X |
| 4,917,235 | 4/1990 | Feiler | 206/6.1 |
| 5,671,849 | 9/1997 | Bacon | 211/85.2 |

*Primary Examiner*—Bryon P. Gehman

*Attorney, Agent, or Firm*—Levisohn, Lerner, Berger & Langsam

[57] ABSTRACT

A tray for displaying rings and photographs of the rings adjacent to the rings comprises a support upon which each ring is placed in a slot adjacent to the corresponding photograph of that ring. The support includes an internal cavity for storing a booklet, video cassette or other article.

12 Claims, 2 Drawing Sheets

TRAY FOR DISPLAYING A PLURALITY OF JEWELRY ITEMS AND INFORMATION RELATING TO THE JEWELRY ITEMS

TECHNICAL FIELD

The invention relates to a tray for displaying for sale a plurality of jewelry items, preferably rings. The tray is provided with a plurality of slots for holding the rings and, beneath or adjacent the ring holding slots is a photograph of the respective ring. This facilitates replacing the ring into the proper slot after it has been removed for consideration by the potential purchaser. More particularly, the invention relates to a tray for displaying a plurality of jewelry items and having visual images adjacent to the ring holding slots for facilitating the returning of the rings into the tray. Also, a cavity is provided within the tray to conveniently hold a booklet housing written information (such as, an order guide, with retail price, style number and item number, for example) for the displayed rings.

BACKGROUND OF THE INVENTION

The process of selling jewelry, including finger rings, often is a time-demanding and labor intensive process. Typically, a major retailer of jewelry employs a number of salespersons who meet with potential customers, displaying jewelry items and communicating information concerning the jewelry items to the potential customer for the purposes of making a sale.

It is important for the seller of jewelry to be able to readily, easily and accurately communicate to the potential customer information concerning the jewelry for sale. This is especially important where the seller of jewelry is selling special order items, which are jewelry items specifically manufactured for a particular customer. For special order items, for example for a ring, a customer may select a particular style, size, stone(s) and sequence of stones. Special order items are more difficult sales than non-special order items, because they are complicated by the number of options available to the customer and the possibility that the seller may make a mistake in communicating erroneous information concerning the jewelry, such as, quoting an erroneous price, or an unavailable stone.

Commonly, the seller of jewelry needs to display the jewelry item to the customer, identify the jewelry, and provide pricing, styling or other relevant information to the potential customer in order to sell the jewelry. Usually, the seller of jewelry has a limited time period available to make his or her sale's pitch. Typically, the jewelry salesperson is positioned behind a sales showcase, which contains the jewelry items which are to be shown to customers, and has separate printed materials, such as price lists, information booklets describing the jewelry or catalogues, which the salesperson consults during the sales negotiations. Often, it has been difficult for a salesperson to display the jewelry to a potential customer and to expeditiously, conveniently and correctly provide the pricing, styling, or other relevant information required by the potential customer to determine if he or she will buy the jewelry. Frequently, the salesperson has to sort through various materials to locate the printed information which corresponds to the jewelry piece which the salesperson is attempting to sell, often resulting in a delay and sometimes resulting in providing erroneous information, which may interfere with the salesperson's ability to complete the sale.

Accordingly, there is a need in the art for a tray displaying jewelry having a means for correctly providing information identifying or otherwise relating to the jewelry items displayed and providing for easy and rapid access to information relating to the jewelry. There is also a need in the art for a tray displaying jewelry having a means for assisting the salesperson in returning rings removed from a jewelry tray to their respective original positions in the jewelry tray.

An object of the present invention is to provide a tray for displaying jewelry items having slots for holding jewelry items and having a means to provide for easy and rapid access to information relating to the jewelry.

A further object of the present invention is to provide a tray for displaying jewelry with a means for displaying a picture of the jewelry near to the jewelry item displayed to facilitate returning the ring to the proper holding slot for the ring.

A further object of the present invention is to provide a tray for displaying jewelry with a pocket for holding a card or booklet having information relating to the jewelry displayed to facilitate providing accurate information relating to the jewelry.

Other objects, advantages and features of this invention become more apparent hereinafter.

SUMMARY OF THE INVENTION

The invention relates to a tray for displaying for sale a plurality of jewelry items, preferably rings. The tray is provided with a plurality of slots for holding the rings and, beneath or adjacent to the ring holding slots is a photograph or picture of the respective ring. This facilitates replacing the ring into the proper slot after it has been removed for consideration by the potential purchaser. In another aspect of the invention a pocket is provided within the tray to conveniently hold a booklet housing written information, such as, an order guide, with retail price, style number and item number, for example, for the displayed rings.

DESCRIPTION OF THE PREFERRED EMBODIMENTS

Figure 1:
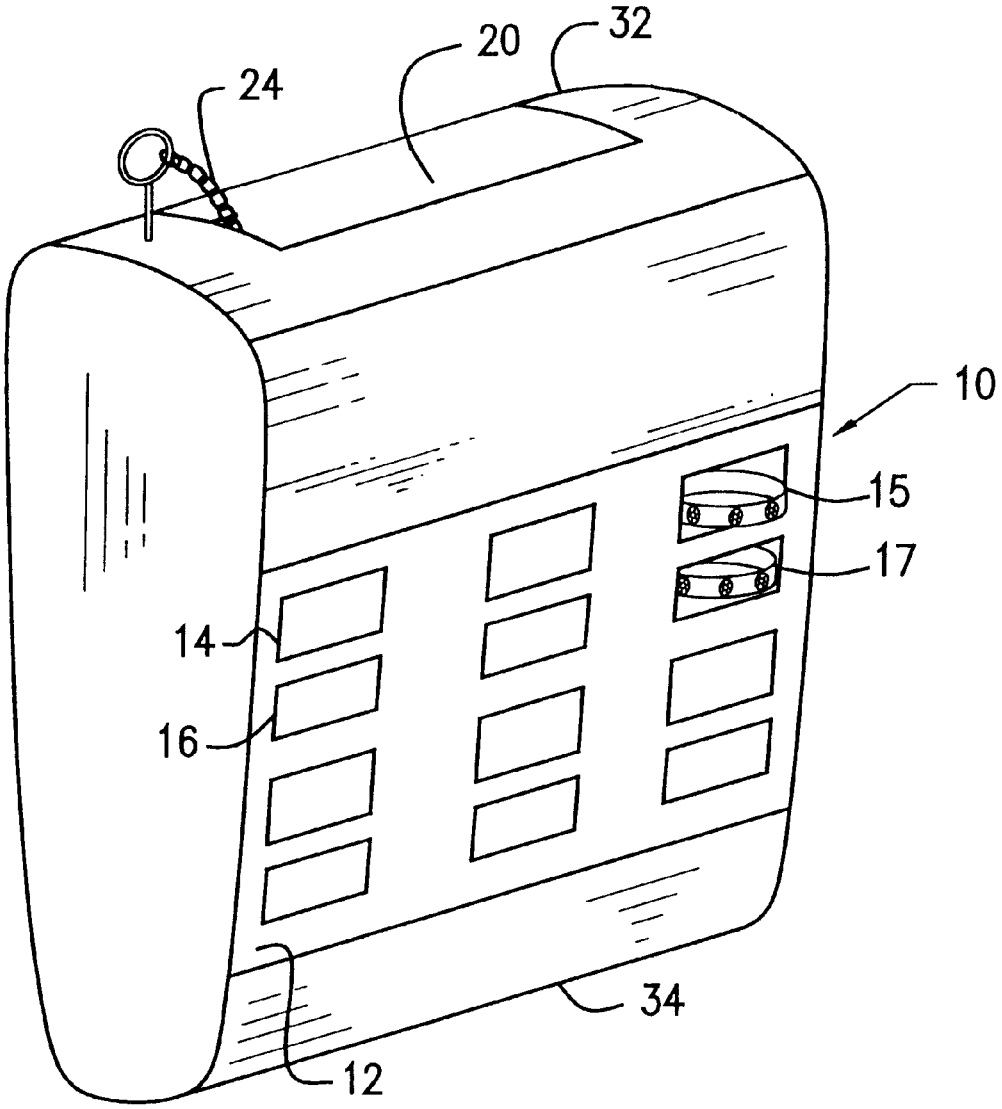
FIG. 1 is a front perspective view of the tray for displaying jewelry.

The tray for displaying jewelry illustrated in FIG. 1 comprises a support 12 forming tray 10, having a plurality of slots 14 for holding respective ones of a plurality of jewelry items 15. FIG. 1 shows an illustrative jewelry item 15. The tray further comprises a plurality of respective images 17 with each of the images corresponding to respective ones of the plurality of jewelry items 15. FIG. 1 shows an illustrative image 17. The tray comprises a support area 16 to mount each of the images 17 proximate to each of the corresponding jewelry items 15. The tray is known in the art and typically, comprises molded plastic or wood, has thereon a covering, such as styrofoam, rubber or such other cushioning material. The tray has on the covering a pad, such as leatherette or such other material preferably having a design look and both the covering and the pad may be matchingly die cut to provide for a plurality of slots for holding jewelry and the pad may also be die cut to provide cut-outs for the images 17.

The images 17 may be. photographic pictures of the jewelry items 15. In a preferred embodiment the pictures are formed by a method, known in the art, on a template which is die struck with cut-outs to fit over the jewelry items 15, has the pictures or images of each jewelry item located beneath the cut-out where the respective ring will be inserted, and the template is located on top of the cushioning material and beneath the pad, which is provided with cut-outs corresponding to the cut-outs on the template and with cut-outs corresponding to the location of the images on the template. In other embodiments, as known in the art, the images 17 are affixed by adhesive or other means known in the art to the tray to be proximate to, and beneath or adjacent to the corresponding jewelry items 15. The methods known in the art allow for easy removal and replacement of images 17 from the tray 10 so that the images displayed may be changed from time to time. However, the attachment means may comprise adhesive, such as glue or tape, or any other means known in the art to connect the respective image 17 to the respective support area 16.

The jewelry items 15 are rings, pendants, pins, clasps or other jewelry. The slots 14 have a cushioning material or such other means, as known in the art, to allow each of the jewelry pieces to be held in place within each slot and to be easily removed from the slot, as needed. The tray may have any shape. As illustrated in FIG. 1, the tray comprises a wedge shape, such that back side 32 is higher than the front side 34, and thus forms a slope for better display of the jewelry items 15.

Figure 2:
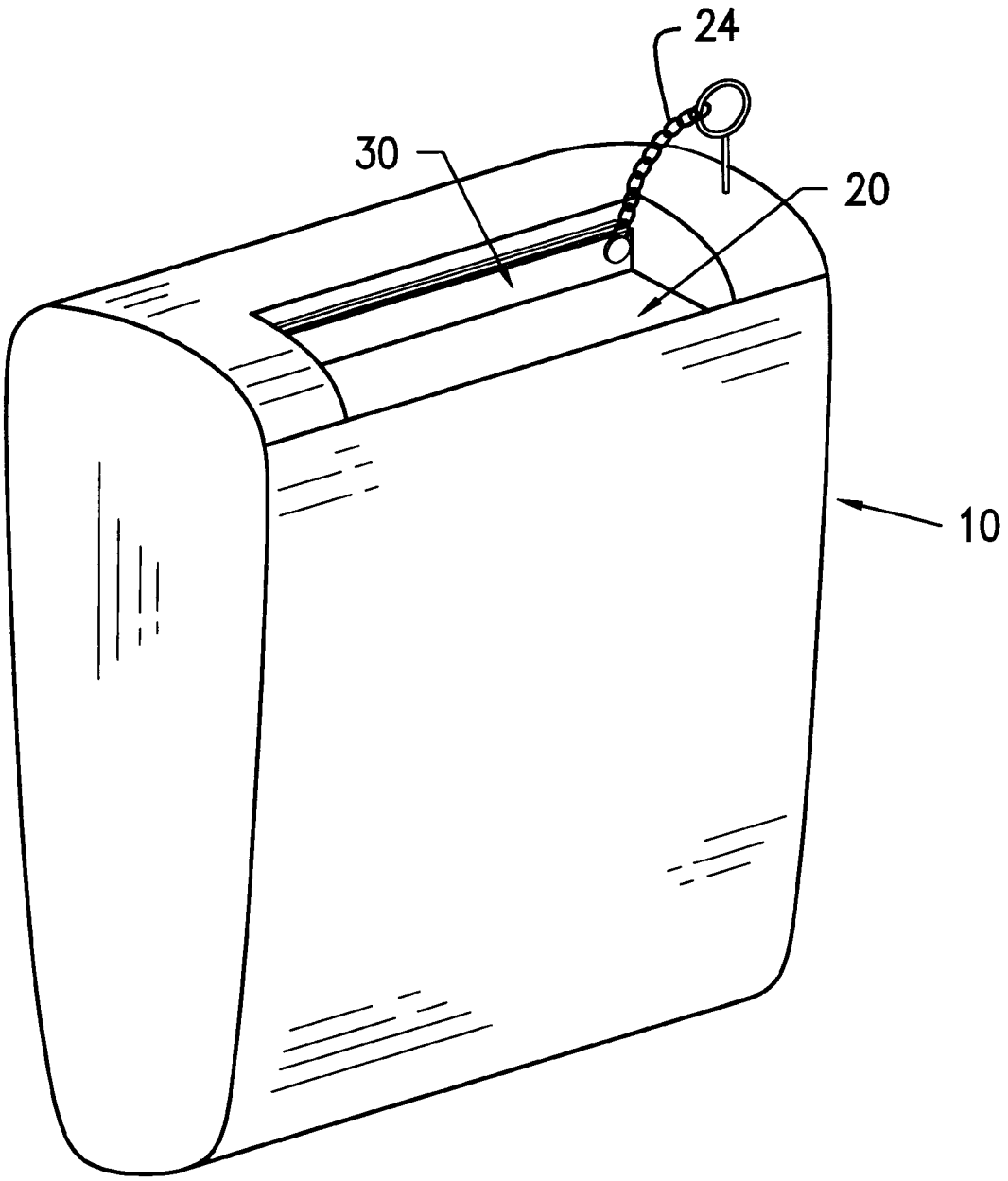
FIG. 2 is back perspective view of the tray for displaying jewelry.

The tray 10, as illustrated in FIG. 2, further comprises a pocket 20 for containing an article which contains information about the plurality of jewelry items. In a preferred embodiment the pocket 20 is formed by an opening from the back 32 of the tray 10 which forms a cavity sized to allow for the insertion of a booklet 30, or other article containing information about the jewelry items. The article containing information about the jewelry items may also comprise a video cassette, audio cassette or other means for communicating information about the jewelry displayed. In an embodiment the pocket 20 is sized only slightly larger than the booklet 30 or article to allow the insertion of a booklet or article within the pocket such that the booklet or article fits appropriately within the pocket.

As illustrated in FIG. 2, in a preferred embodiment an article 30 which contains information about the jewelry items 15 may be securely attached to the tray 10 by a chain 24 or such other connecting means, as known in the art. The chain 24 at one end is attached to the article 30 and at its other end is attached to the tray 10 by means known in the art.

The manner of using the illustrated tray for displaying jewelry will now be described. The plurality of jewelry items 15 are respectively placed into the slots 14 for holding the jewelry. The plurality of images 17 respectively depicting each jewelry item 15 are placed in the respective supporting area 16 beneath the corresponding jewelry item 15. The article which contains information about the plurality of jewelry pieces is placed within the pocket 20 formed in the rear of the tray 10. When the user of the tray 10 desires access to the article which contains information about the plurality of jewelry pieces, the user may rapidly and easily remove the article, and, when desired, return the article for convenient storage in the pocket 20. The user of the tray 10 may change the jewelry items 15 and may change the images 17 so that the tray may be conveniently used to display the jewelry items and images which the user desires to display.

In a preferred embodiment, the images 17 are arranged in an order convenient to the user, such as, by way of example only, to correspond with the order of the pricing list for each of the jewelry items, as contained in the article 30, and each of the respective images 17 are situated beneath each of the respective corresponding jewelry items 15. Thus, when a user of the display removes a plurality of jewelry items 15, the corresponding images 17 remain in place and serve as indicators of where the removed jewelry items 15 should be replaced. The images 17 thus allow the user of the jewelry display to maintain an orderly arrangement of the jewelry items 15 and allow the user to efficiently relate the information contained in the article 30 to each of the respective jewelry items 15. However, the display may be used with or without the article 30.

While the invention has been described with respect to particular applications, it will be appreciated that the described display may be used for other purposes. Many other variations and applications of the invention will be apparent. The above specification and the detailed description of the preferred embodiment are to be considered as representative, only, as the scope of the invention is intended to be covered by the scope of the claims, as interpreted by the Courts, and their reasonable and legal equivalents, as also interpreted by the Courts and the applicable statutes.

What is claimed is:

1. A tray for displaying a plurality of rings comprising: a support forming said tray, said support comprising a plurality of slots for holding rings, and further comprising a plurality of photographs of rings, wherein each of said photographs has an image of a corresponding ring, said tray comprising a support area to mount each respective one of said photographs proximate to a respective slot for holding the corresponding ring.

2. A tray for displaying a plurality of rings as claimed in claim 1 wherein the support forming said tray further comprises a cavity formed by an opening behind the tray which forms said cavity, said cavity being sized to contain an article selected from the group consisting of a booklet, video cassette and audio cassette.

3. A tray for displaying a plurality of rings as claimed in claim 2 further comprising a plurality of rings which correspond to said photographs.

4. A tray for displaying a plurality of rings as claimed in claim 2 wherein said plurality of slots are arranged in rows and columns.

5. A tray for displaying a plurality of rings as claimed in claim 1 further comprising a plurality of rings which correspond to said photographs.

6. A tray for displaying a plurality of rings as claimed in claim 5 wherein said plurality of slots are arranged in rows and columns.

7. A tray for displaying a plurality of rings as claimed in claim 6 wherein each of said rings further comprises a stone.

8. A tray for displaying a plurality of rings as claimed in claim 7 wherein said rings are special order rings.

9. A tray for displaying a plurality of rings as claimed in claim 8 wherein said rings further comprise birth stones.

10. A tray for displaying a plurality of rings as claimed in claim 5 wherein said rings are special order rings and the plurality of slots are arranged in rows and columns.

11. A tray for displaying a plurality of rings as claimed in claim 5 wherein said rings are special order rings, the plurality of slots are arranged in rows and columns and the tray is made of molded plastic.

12. A tray for displaying a plurality of rings as claimed in claim 1 wherein said plurality of slots are arranged in rows and columns.

* * * * *